US005674449A

United States Patent [19]

Liang et al.

[11] Patent Number: 5,674,449

[45] Date of Patent: Oct. 7, 1997

[54] IRON BASE ALLOYS FOR INTERNAL COMBUSTION ENGINE VALVE SEAT INSERTS, AND THE LIKE

[75] Inventors: Xuecheng Liang, Marinette, Wis.; Gary R. Strong, Menominee, Mich.

[73] Assignee: Winsert, Inc., Marinette, Wis.

[21] Appl. No.: 450,262

[22] Filed: May 25, 1995

[51] Int. Cl.[6] ..... C22C 38/24; C22C 38/22

[52] U.S. Cl. ..... 420/12; 420/100; 420/101; 420/102

[58] Field of Search ..... 420/100, 101, 420/102, 12

[56] References Cited

U.S. PATENT DOCUMENTS

| | | | |
|---|---|---|---|
| 1,599,425 | 9/1926 | McGuire . | |
| 2,113,937 | 4/1938 | Franks . | |
| 2,159,723 | 5/1939 | Franks . | |
| 2,590,835 | 4/1952 | Kirkby et al. . | |
| 2,693,413 | 11/1954 | Kirkby et al. . | |
| 2,793,113 | 5/1957 | Rait et al. . | |
| 2,809,109 | 10/1957 | Field . | |
| 3,295,966 | 1/1967 | Steven . | |
| 3,756,808 | 9/1973 | Webster . | |
| 3,850,621 | 11/1974 | Haberling et al. . | |
| 3,859,147 | 1/1975 | Philip . | |
| 3,873,378 | 3/1975 | Webster . | |
| 3,876,447 | 4/1975 | Lally . | |
| 4,075,999 | 2/1978 | Danis . | |
| 4,104,505 | 8/1978 | Rayment et al. . | |
| 4,122,817 | 10/1978 | Matlock . | |
| 4,224,060 | 9/1980 | de Souza et al. | 75/124 |
| 4,568,393 | 2/1986 | Kane et al. . | |
| 4,724,000 | 2/1988 | Larson et al. . | |
| 4,729,872 | 3/1988 | Kishida et al. . | |
| 4,822,695 | 4/1989 | Larson et al. . | |
| 4,902,473 | 2/1990 | Arata et al. . | |
| 5,041,158 | 8/1991 | Larson . | |
| 5,116,571 | 5/1992 | Abe et al. . | |
| 5,221,373 | 6/1993 | Schuler et al. . | |

FOREIGN PATENT DOCUMENTS

| | | | |
|---|---|---|---|
| 0 264 528 | 4/1988 | European Pat. Off. | C22C 38/22 |
| 1406696 | 9/1975 | United Kingdom | C22C 38/12 |

*Primary Examiner*—Deborah Yee

*Attorney, Agent, or Firm*—Steven P. Shurtz; Brinks Hofer Gilson & Lione

[57] ABSTRACT

An iron base alloy having high wear resistance at elevated temperatures with good oxidation resistance contains 1–2.8 wt. % carbon, 3–16 wt. % chromium, 1–8 wt. % vanadium, 0.5–5 wt. % niobium, up to 14 wt. % molybdenum and up to 14 wt. % tungsten, the molybdenum and tungsten combined comprising 6–14 wt. % of the alloy.

29 Claims, 2 Drawing Sheets

IRON BASE ALLOYS FOR INTERNAL COMBUSTION ENGINE VALVE SEAT INSERTS, AND THE LIKE

BACKGROUND OF THE INVENTION

The present invention relates to iron base alloys having high wear resistance at elevated temperatures. Such alloys are especially useful for engine parts such as valve seat inserts. In a further aspect, this invention relates to parts made from such alloys, either cast, hard surfaced, or pressed as a powder and sintered.

Currently available iron base alloys for exhaust valve seat inserts are tool steel, such as M2 (by AISI designation) tool steels, and the high carbon, high chromium type steels. Valve seat inserts made of these alloys experience severe seat face wear problems in some heavy duty engine applications. Cobalt and nickel base alloys are the most commonly used materials for valve seat inserts in these heavy duty applications. However, these alloys are expensive due to the high content of expensive cobalt and nickel elements.

U.S. Pat. No. 4,729,872 discloses a tool steel which can be thermally and mechanically stressed without cracking. This is particularly useful for tool steel die applications where the life of a die is shortened primarily by forming cracks in the sharp corners of the die. The steel has low carbon levels because higher carbon will result in cracking as a result of too many carbides.

U.S. Pat. No. 3,859,147 relates to 440 series martensitic stainless steels which require chromium levels of at least 13% and carbon of at least 0.6%. The molybdenum content is limited to 3% because more molybdenum carbides would create an alloy with "poor workability," meaning the alloy would be difficult to forge or shape when hot.

Of course, there are many other iron base alloys that have been developed for particular applications. However, for high wear resistance at elevated temperatures, heretofore only the expensive alloys with cobalt and nickel have been found suitable. Therefore, it would be a great improvement if there were a less expensive alloy that had high wear resistance at elevated temperatures.

SUMMARY OF THE INVENTION

An iron base alloy has been invented which has properties similar to more expensive nickel and cobalt base alloys, particularly a high wear resistance at elevated temperatures. In one aspect, the present invention is an alloy which comprises:

| Element | Wt. % |
|---|---|
| C | 1.0–2.8 |
| Cr | 3.0–16.0 |
| W | 0.0–14.0 |
| Mo | 0.0–14.0 |
| V | 1.0–8.0 |
| Nb | 0.5–0.5 |
| Co | 0.0–12.0 |
| Fe | 56.0–88.5 |

where W and Mo combined comprise 6–14% of the alloy.

In another aspect of the invention, metal parts are either made from the alloy, such as by casting or forming from a powder and sintering, or the alloy is used to hardface the parts.

In addition to high wear resistance, the preferred alloys of the present invention also have good hot hardness and oxidation resistance.

The invention and its benefits will be better understood in view of the following detailed description of the invention and the attached drawings.

DETAILED DESCRIPTION OF THE DRAWINGS AND PREFERRED EMBODIMENTS

Figure 1:
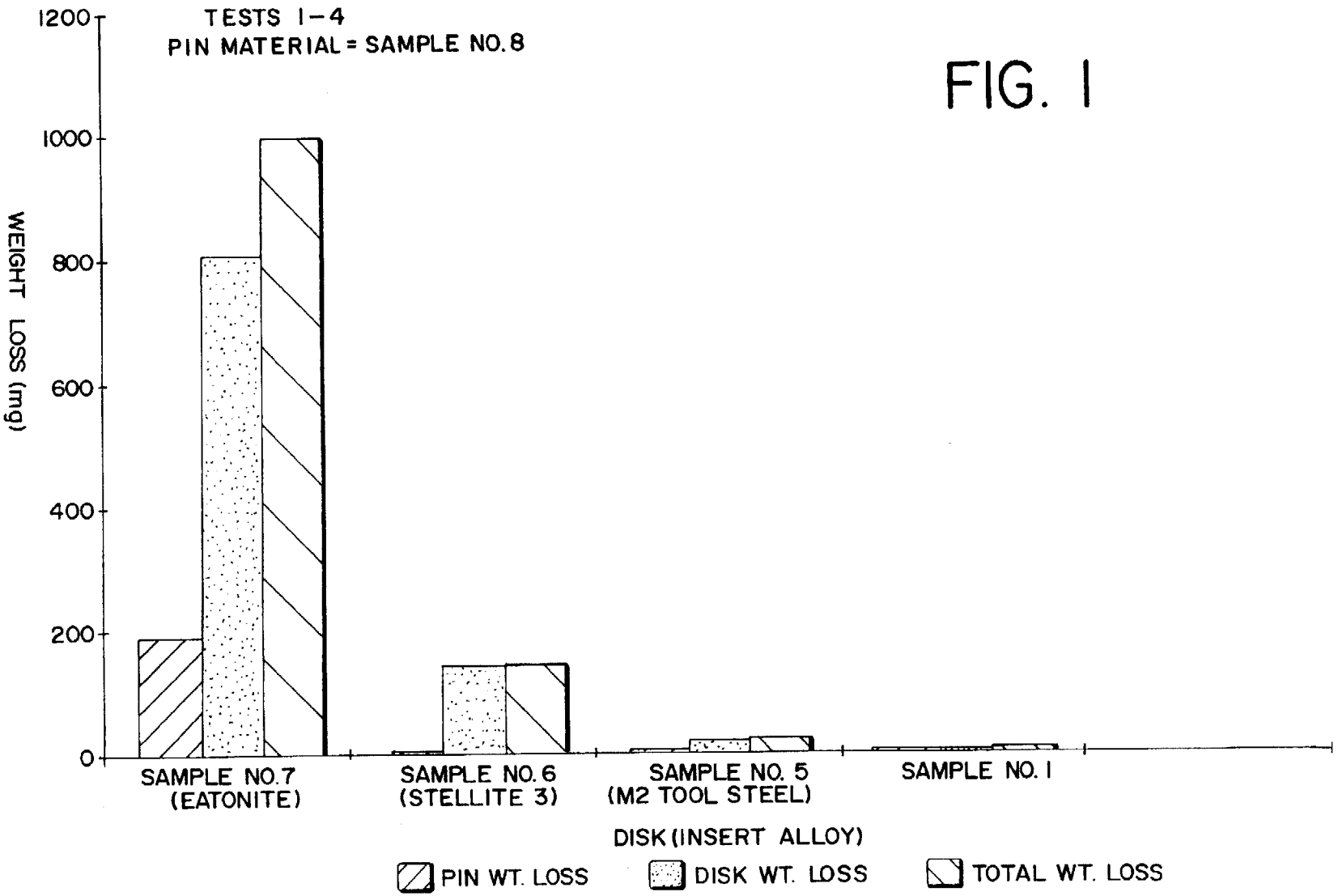
FIGS. 1 and 2 are graphs showing wear test results for parts made from alloys of the present invention and commercially available prior art alloys.

Failure analysis of worn iron base alloy valve seat inserts showed that excess oxidation wear and metal-to- metal sliding wear are common wear mechanisms for iron base alloy valve seat inserts. The present invention is directed to an iron base alloy with improved wear resistance, particularly for use in internal combustion engine valve seat inserts. The present invention is based on the experimental evidence that wear resistance of the iron base alloys can be increased by improving the primary carbide distribution and carefully balancing the chromium content, total carbide volume fraction and matrix hardness.

The total carbide volume fraction refers to the proportion of the volume of carbides to the total measured volume of the alloy (carbides plus matrix). Increasing the carbide volume fraction is believed to reduce the possibility of adhesive wear because adhesive wear occurs primarily between matrix metal surfaces.

Iron will comprise 56 to 85.5 wt. %, preferably 60 to 70 wt. % of the alloy. To the iron base of the alloy is added chromium in an amount from 3 to 16 wt. %, preferably, 6 to 9 wt. %. This chromium content in the iron base alloy significantly improves oxidation resistance by forming a denser and thinner oxide layer. This oxidation layer, together with the support of a stronger metal matrix, reduces the oxidation wear rate and also increases the transition load from oxidation mild wear to severe metallic wear. The transition load refers to the level of mechanical force or load where the protective layer begins to breakdown and plastic deformation of the metal begins, resulting in accelerated wear. However, an excess amount of chromium in the metal matrix can be detrimental to the wear resistance by causing micro-fracturing of the surface layer, thus lowering the transition load. The maximum chromium content permitted is dependent on the total carbide volume fraction and the matrix hardness desired.

Molybdenum and tungsten are each present in the alloy in the amount of up to 14 wt. %, where the total percentage of the two combined is in the range of 6–14 wt. %, preferably 10 to 14 wt. %. Preferably both molybdenum and tungsten will be included, in a ratio of Mo: W of between 1:10 and 10:1. Molybdenum and tungsten form hard complex $M_6C$ type carbides (M=Fe,Mo,W), which are the basis for the high wear resistance of high speed tool steels. The $M_6C$ carbides are stable, resisting softening of the steel at high temperatures and are only partially dissolved at temperatures exceeding 1800° F. Molybdenum and tungsten promote resistance to softening of the matrix base material through solid solution and are essential to the high temperature properties of the alloy of the present invention.

Vanadium is added in the amount of 1 to 8 wt. %, preferably 3 to 6 wt. %. Niobium is also present in the amount of 0.5 to 5 wt. %, preferably 0.8 to 4 wt. %. The addition of vanadium and niobium can further increase the wear resistance because they form MC type carbides, which are more wear resistant than $M_6C$ type carbides. The MC carbides are harder, have good thermal stability and have good interface strength between the carbide and metal matrix. The addition of niobium can also improve the primary carbide distribution in the matrix because (Nb, V) C carbides form in the matrix areas between the $M_6C$ carbide network, which is beneficial to the wear resistance of the iron base alloy.

Carbon is present in the alloy in the amount of 1 to 2.8 wt. %, preferably 1.2 to 2 wt. %. The carbon is needed to form the carbides and to affect the matrix strength through heat treating. The carbon content is selected based on the chromium content and the matrix hardness desired to achieve maximum wear resistance.

Cobalt can be added in the amount of up to 12 wt. % to provide additional hot hardness and improve metal matrix work hardening ability at elevated temperatures of 600° to 1200° F. The cobalt addition is not essential to the invention, but adds to the performance ability of alloys of the present invention. After some preliminary testing, it is preferred to use 2 to 8 wt. % cobalt, and most preferably 3 to 6 wt. %.

Nickel may be added at levels up to 18 wt. % when an austenitic grade alloy is desired. Such an alloy will provide more high temperature strength and hot hardness than the alloy without nickel. When nickel is used, at least 4 wt. % nickel is preferably added. The high nickel alloy will result in higher wear rates at lower temperatures and therefore it is only added for special situations.

The elements silicon and manganese may be added at levels of up to 1.5 wt. % to strengthen the matrix and, when the alloy is used in castings, to help deoxidize the metal. Other elements may be present in greater or lesser amounts depending on their presence in the raw materials or scrap mix used to make the alloy of this invention.

A further understanding is given of the uniqueness and benefits of the invention in the following examples, in which all parts and percentages are given by weight.

EXAMPLES AND TESTING

Alloy specimens were cast and machined as rings, pin cylinders, or disk cylinders as needed to perform measurements of particular properties of the test specimens. Four different alloy Examples of the present invention, three prior art alloys in their commercially available form, and two commercial hard facing alloys, diluted with 10% iron, were used to make the various test parts. The nominal compositions of the samples tested are provided in Table I.

TABLE I

| | | Element in wt % (nominal) | | | | | | | | |
|---|---|---|---|---|---|---|---|---|---|---|
| Sample No. | Example No. or Trade Name | C | Cr | Mo | W | V | Nb | Co | Ni | Fe |
| 1 | Example 1 | 1.8 | 8 | 11 | 1 | 4 | 1 | 4.5 | — | Bal. |
| 2 | Example 2 | 1.8 | 8 | 1 | 11 | 4 | 1 | 4.5 | — | Bal. |
| 3 | Example 3 | 1.8 | 8 | 6 | 6 | 4 | 1 | 4.5 | — | Bal. |
| 4 | Example 4 (Austenitic) | 1.6 | 12 | 6 | 6 | 4 | 3 | 4.5 | 12 | Bal. |
| 5 | M2 Tool Steel | 1.3 | 4 | 6.5 | 5.5 | 1.5 | — | — | — | Bal. |
| 6 | Stellite 3 | 2.4 | 30 | — | 12.8 | — | — | Bal. | 2 | 2 |
| 7 | Eatonite | 2.3 | 29 | — | 15.0 | — | — | — | Bal. | 4.5 |
| 8 | Stellite 1 + 10% Fe | 2.4 | 30 | — | 12.8 | — | — | Bal. | 2 | 10 |
| 9 | Stellite 6 + 10% Fe | 1.0 | 29 | — | 4.8 | — | — | Bal. | 2 | 10 |

"Stellite" is a trademark of Deloro Stellite, Kokomo, Ind. and "Eatonite" was developed by Eaton Corp. of Marshal, Mich. M2 tool steel was selected for Sample No. 5 as a comparison because it is considered a premier wear resistant iron alloy. Eatonite and Stellite are premier nickel and cobalt base alloys used for high temperature wear resistant applications, such as valve facing and valve seat insert applications. For Sample Nos. 8 and 9, Stellite 1 and Stellite 6, each with 10% added iron, represent the typical chemical composition of an engine valve hardfaced with Stellite 1 and Stellite 6, since the overlay process typically results in a 10 percent dilution of the hardfacing seat surface material with the iron base metal.

Hot Hardness Test

Hot hardness testing was performed at various temperatures on ring specimens placed in a heated chamber containing an argon atmosphere. Using ASTM Standard Test Method E92-72, hardness measurements were taken at various temperature increments after holding the specimen at the temperature for 30 minutes. The hardness was measured using a ceramic pyramid indenter having a Vickers diamond pyramid face angle of 136 degrees and a load of 10 kg making 5–10 indentations around the top surface of the ring sample.

With the sample cooled to room temperature, the hardness indentation diagonals were measured using a filar scale under a light microscope and the values converted to Vickers Hardness Number (diamond pyramid hardness) using a standard conversion table. The average hardness of the specimens at the various temperatures are given as converted to Rockwell C hardness in Table II. The conversions were made using ASTM E140-78 Standard Hardness Conversion Tables for Metals.

TABLE II

Hot Hardness Properties Reported in Rockwell C Hardness

| Sample | Temperature at test | Room Temp | 400° F. | 800° F. | 1000° F. | 1200° F. | 1400° F. |
|---|---|---|---|---|---|---|---|
| 1 | Example 1 | 54.0 | 50.5 | 45.5 | 39.5 | 12.0 | — |
| 2 | Example 2 | 56.0 | 53.5 | 50.0 | 39.5 | 18.0 | — |
| 3 | Example 3 | 55.0 | 53.5 | 51.0 | 42.5 | 5.0 | — |
| 4 | Example 4 (Austenitic) | 39.0 | 32.7 | 30.0 | 27.5 | 25.0 | 17.5 |
| 5 | M2 Tool Steel | 41.4 | 34.5 | 30.0 | 23.5 | 1.5 | — |
| 7 | Eatonite | 43.1 | 41.0 | 36.0 | 35.5 | 33.0 | 17.5 |

As can be seen in Table II, for the hot hardness in the 1000°–1400° F. range, the values for the Example 1, 2, and 3 alloys are an improvement over the standard M2 tool steel, the family to which alloys of the present invention most closely belong. The Example 4 austenitic version of the invention has a hardness approaching that of the Eatonite nickel based alloy.

Pin On Disk Wear Test

Figure 2:
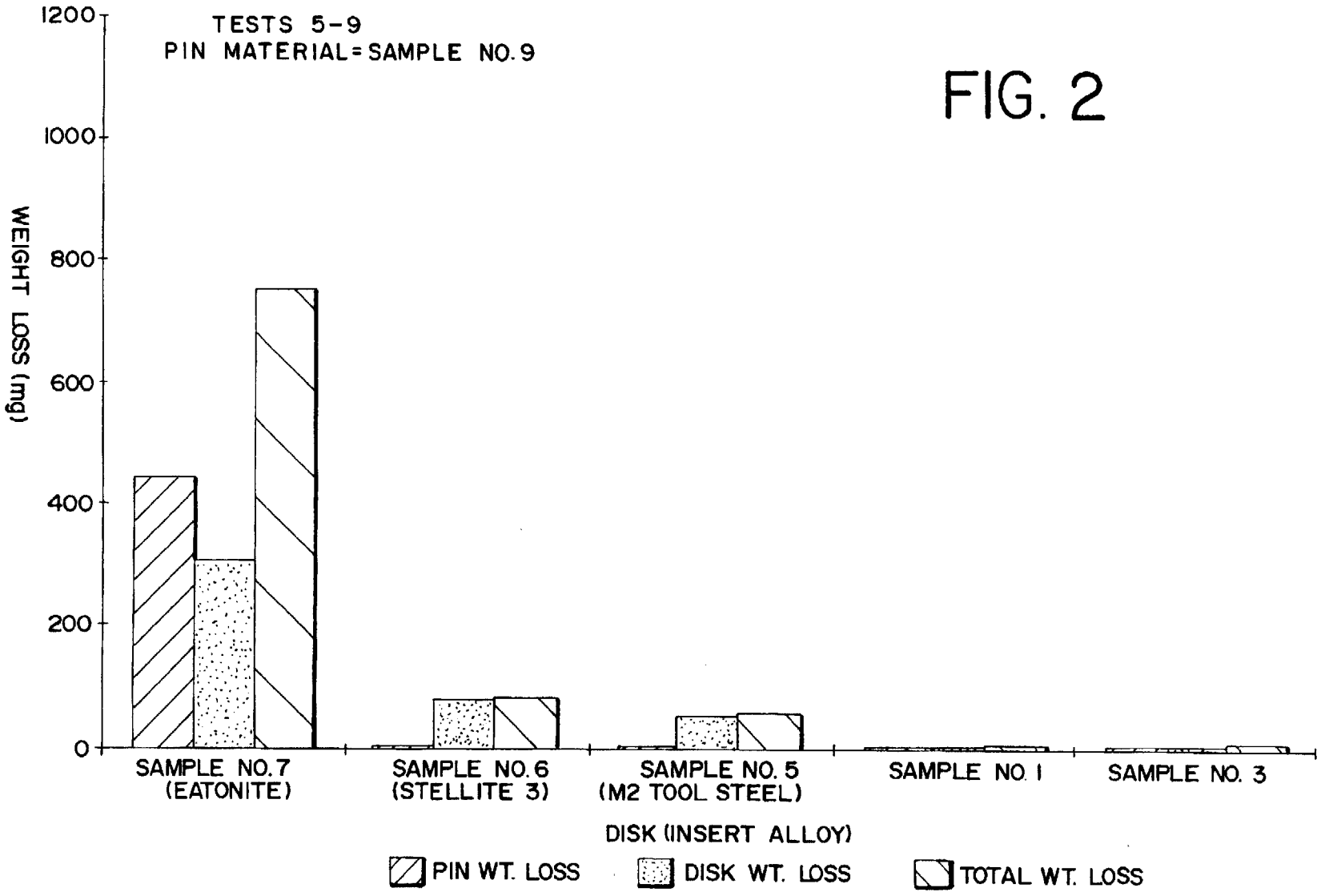

The pin on disk wear test is a universal means of measuring the wear between two mating material surfaces. It is commonly used to measure adhesive wear, the most common wear mechanism between the valve and valve seat insert in internal combustion engines. The pin sample represents common engine valve materials and the disk represents engine valve seat insert materials. The tests were performed using a modification of ASTM Standard Test Method G99-90$^{\epsilon 1}$. The test method was modified using a flat end pin specimen and heating the samples in a furnace chamber at 800° F. prior to and during performance of the test. The standard test is normally performed at room temperature with a radius tip. A load of 45 pounds was placed on the pin while in contact with the disk, which was oriented horizontally. The disk was rotated at a velocity of 0.42 ft/sec for a total sliding distance of 837 feet. The weight loss was measured on both the pin and disk sample after each test using a balance having a precision of 0.1 mg. Two pin materials and five disk material were tested. The pin materials represent common high performance valve materials. In tests 1–4, the pin was made of Sample No. 8 material (Stellite 1 with 10% added iron). In Tests 5–9, the pin was made of Sample No. 9 material (Stellite 6 with 10% added iron). The disk materials were Sample Nos. 1, 3, 5, 6 and 7. The average weight loss of 4–6 test runs on each combination is listed in the Table III. The results of the data from Table III are illustrated in FIGS. 1 and 2.

TABLE III

Wear Test Results Reported in Grams of Weight Loss

| | | Tests 1–4 (FIG. 1) | | Tests 5–9 (FIG. 2) | |
|---|---|---|---|---|---|
| Sample No. | Disk Material | Disk Wt. Loss | Pin Wt. Loss | Disk Wt. Loss | Pin Wt. Loss |
| 1 | Example 1 | 0.0028 | 0.0032 | 0.0016 | 0.0015 |
| 3 | Example 3 | | | 0.0050 | 0.0042 |
| 5 | M2 Tool Steel | 0.0201 | 0.0011 | 0.0550 | 0.0035 |
| 6 | Stellite 3 | 0.1408 | 0.0008 | 0.0812 | 0.0017 |
| 7 | Eatonite | 0.8058 | 0.1913 | 0.3035 | 0.4411 |

The FIG. 1 bar graph shows the weight loss of the pin, the disk insert material and total combined weight loss for Tests 1–4, using the Sample No. 8 (Stellite 1+10% Fe dilution) pin in combination with the various disk insert alloys. FIG. 2 is a bar graph showing the same weight losses for Tests 5–9, using the Sample No. 9 (Stellite 6+10% Fe dilution) pin.

From viewing both Figures, it is clear that the invention represented by Examples 1 and 2 results in a substantial reduction in wear weight loss compared to that of the Eatonite nickel based alloy, the Stellite 3 cobalt based alloy and M2 tool steel.

Oxidation Corrosion

An oxidation corrosion test was performed using standard laboratory practice by measuring the weight gain of specimens held at a constant temperature with the various increments of increasing time. Specimens were placed in magnesia crucibles and held at 800° F. up to 500 hours. The samples were cooled and placed in a desiccator until they reached room temperature and then weighed again. The weight gain was recorded as a measure of the oxidation product formed using a balance with a precision of 0.1 mg. The results were converted to a rate of weight gain per hour for the surface area of the sample. The average of three samples from the 500 hour test is given in Table IV.

TABLE IV

500 Hour Average Oxidation Rate at 800° F.

| Sample No. | Material | 500 Hours Average Weight Gain |
|---|---|---|
| 2 | Example 2 | 2.3 mg/m$^2$/hr |
| 5 | M2 Tool Steel | 6.8 mg/m$^2$/hr |

The results show that the alloy of Example 2 of the invention has approximately 65 percent less rate of weight gain after 500 hours than the commercial M2 tool steel. This data therefore suggests that M2 tool steel is more susceptible to oxidation by a factor of approximately 2.9:1 than the Example 2 alloy. The nickel based Eatonite and cobalt based Stellite materials were not tested for oxidation because these materials are known to have excellent resistance to oxidation and would result in a negligible rate of weight change.

It should be appreciated that the alloys of the present invention are capable of being incorporated in the form of a variety of embodiments, only a few of which have been illustrated and described above. The invention may be embodied in other forms without departing from its spirit or essential characteristics. It will be appreciated that the addition of some other ingredients, materials or components not specifically included will have an adverse impact on the present invention. The best mode of the invention may therefore exclude ingredients, materials or components other than those listed above for inclusion or use in the invention. However, the described embodiments are considered in all respects only as illustrative and not restrictive, and the scope of the invention is, therefore, indicated by the appended claims rather than by the foregoing description. All changes which come within the meaning and range of equivalency of the claims are to be embraced within their scope.

What is claimed is:

1. A high temperature iron base alloy possessing excellent wear resistance combined with good hot hardness and oxidation resistance comprising:

| Element | Wt. % |
|---|---|
| C | 1.6–2 |
| Cr | 6–9 |
| W | 0.0–14.0 |
| Mo | 0.0–14.0 |
| V | 1.0–8.0 |
| Nb | 0.5–5.0 |
| Co | 2.0–12.0 |
| Fe | 56.0–88.5 |

where W and Mo combined comprise 6–14% of the alloy.

2. A part for an internal combustion engine comprising the alloy of claim 1.

3. The part of claim 2 where the part is formed by casting the alloy, hardfacing with the alloy or pressing the alloy as a powder which is then sintered to form the part.

4. The alloy of claim 1 further comprising 4 to 18 wt % nickel.

5. The alloy of claim 1 wherein vanadium comprises 3 to 6 wt. % of the alloy.

6. The alloy of claim 1 wherein niobium comprises 0.8 to 4 wt. % of the alloy.

7. The alloy of claim 1 wherein cobalt comprises 2 to 8 wt. % of the alloy.

8. The alloy of claim 1 wherein iron comprises 60 to 73 wt. % of the alloy.

9. The alloy of claim 1 wherein tungsten and molybdenum combined comprise 10 to 14 wt. % of the alloy.

10. The alloy of claim 1 wherein cobalt comprises 3 to 6 wt. % of the alloy.

11. An iron base alloy comprising 1.6 to 2 wt. % carbon, 6 to 9 wt. % chromium, 3 to 6 wt. % vanadium, 0.8 to 4 wt. % niobium, 3 to 6 wt. % cobalt, 60 to 73 wt. % iron and 10 to 14 wt. % of the combination of tungsten and molybdenum wherein the ratio of tungsten to molybdenum in the combination is between 1:10 and 10:1.

12. The alloy of claim 1 wherein the carbon comprises between 1.6% and 1.8% of the alloy.

13. The part of claim 2 wherein the part has a Rockwell C hardness, at room temperature, of between about 54 and about 56.

14. An iron base alloy comprising 1.6–2 wt. % carbon, 3 to 9 wt. % chromium, 1 to 8 wt. % vanadium, 0.5 to 5 wt. % niobium, 0 to 12 wt. % cobalt, 56 to 88.5 wt. % iron and 10 to 14 wt. % of tungsten, molybdenum or a combination of tungsten and molybdenum.

15. A part formed by casting the alloy of claim 1.

16. A part formed by casting the alloy of claim 11.

17. A part formed by casting the alloy of claim 14.

18. An iron base alloy possessing excellent wear resistance combined with good hot hardness and oxidation resistance consisting essentially of 1.6 to 2 wt. % carbon, 6 to 9 wt. % chromium, 1–8 wt. % vanadium, 0.5 to 5 wt. % niobium, 2 to 12 wt. % cobalt, 0 to 1.5 wt. % silicon, 0 to 1.5 wt. % manganese, 56–88.5 wt. % iron, and 10 to 14 wt. % of tungsten, molybdenum or a combination of tungsten and molybdenum.

19. An iron base alloy possessing excellent wear resistance combined with good hot hardness and oxidation resistance consisting of 1.6 to 2 wt. % carbon, 6 to 9 wt. % chromium, 3 to 6 wt. % vanadium, 0.8 to 4 wt. % niobium, 3 to 6 wt. % cobalt, 0 to 1.5 wt. % silicon, 0 to 1.5 wt. % manganese, 60 to 73 wt. % iron, and 10 to 14 wt. % of tungsten, molybdenum or a combination of tungsten and molybdenum.

20. The alloy of claim 1 wherein the molybdenum comprises 6 to 11 wt. % of the alloy.

21. The alloy of claim 14 wherein the cobalt comprises 2 to 8 wt. % of the alloy.

22. The alloy of claim 1 comprising about 1.8 wt. % carbon, about 8 wt. % chromium, about 11 wt. % molybdenum, about 1 wt. % tungsten, about 4 wt. % vanadium, about 1 wt. % niobium, about 4.5 wt. % cobalt, and the balance iron.

23. The alloy of claim 1 comprising about 1.8 wt. % carbon, about 8 wt. % chromium, about 1 wt. % molybdenum, about 11 wt. % tungsten, about 4 wt. % vanadium, about 1 wt. % niobium, about 4.5 wt. % cobalt, and the balance iron.

24. The alloy of claim 1 comprising about 1.8 wt. % carbon, about 8 wt. % chromium, about 6 wt. % molybdenum, about 6 wt. % tungsten, about 4 wt. % vanadium, about 1 wt. % niobium, about 4.5 wt. % cobalt, and the balance iron.

25. The alloy of claim 1 wherein molybdenum comprises about 11% of the alloy.

26. The alloy of claim 25 wherein tungsten comprises about 1% of the alloy.

27. A valve seat insert comprising the alloy of claim 1.

28. A valve seat insert comprising the alloy of claim 11.

29. A valve seat insert comprising the alloy of claim 14.

* * * * *

UNITED STATES PATENT AND TRADEMARK OFFICE

CERTIFICATE OF CORRECTION

PATENT NO. : 5,674,449

DATED : October 7, 1997

INVENTOR(S) : Xuecheng Liang et al.

It is certified that error appears in the above-indentified patent and that said Letters Patent is hereby corrected as shown below:

In the Title Page

In column 2, after line 1, under "FOREIGN PATENT DOCUMENTS" add new material as follows:

| | | |
|---|---|---|
| --59-229465 | 12/1984 | Japan |
| 3237985 | 9/1983 | Germany |
| 1002397 | 3/1983 | Russia--. |

In column 1, line 59, replace "0.5-0.5" with --0.5-5.0--.

In column 5, line 59, replace "material" with --materials--.

Signed and Sealed this

Fifteenth Day of December, 1998

Bruce Lehman

*Attest:*

BRUCE LEHMAN

*Attesting Officer*

*Commissioner of Patents and Trademarks*